United States Patent [19]

Stone

[11] 4,388,874

[45] Jun. 21, 1983

[54] PREFABRICATED CONCRETE VAULT

[76] Inventor: Frank K. Stone, 2227 SE. Division, Portland, Oreg. 97202

[21] Appl. No.: 210,823

[22] Filed: Nov. 26, 1980

[51] Int. Cl.[3] ..... E05G 1/024

[52] U.S. Cl. ..... 109/79

[58] Field of Search ..... 52/600, 601; 109/79, 109/73

[56] References Cited

U.S. PATENT DOCUMENTS 3,747,287 7/1973 Finger ..... 52/601

4,158,338 6/1979 Dippoid et al. ..... 109/79

*Primary Examiner*—Robert Peshock

*Attorney, Agent, or Firm*—Kolisch, Hartwell & Dickinson

[57] ABSTRACT

A walled structure forms an inner protected area and is made up of prefabricated roof, floor, side and end wall members. These members have jointed overlapping connection with adjacent members with peripheral edges thereof having offset surfaces from each other across the seam of the joint to provide non-continuous burglar-proof seams which lead from the exterior of said vault to the inner protected area. The joints are arranged to provide a minimum of exterior seams. The members of the vault are secured together by disconnectable weld plates for the purpose of disassembling the structure in temporary installations.

6 Claims, 8 Drawing Figures

12
28
24
52
44
22b
22a
40b
B
50
18
40
20
40a
42
A
22
16
32
C
32a
32b
34
14
D

PREFABRICATED CONCRETE VAULT

BACKGROUND OF THE INVENTION

This invention relates to new and useful improvements in concrete vaults.

Most vaults, such as bank vaults, are constructed of poured-in-place concrete. In view of the necessity for constructing forms at the site, inserting steel reinforcement, trucking in the concrete, working around weather conditions, and other factors that may cause delay, such type of construction is expensive and extremely time consuming. Concrete must also cure for a selected time after construction. In most cases, other structural phases of bank construction are delayed during the time that the vault is being constructed on the site, thus consuming additional time in the over-all construction of the building. Also, many bank installations are not permanent, and in such case the poured-in-place type of concrete vault is an uneconomical structure since not only does the vault have the above enumerated disadvantages but if the bank is to be moved the vault must be demolished and disposed of. In addition to being time consuming in removing the building, such is also an expensive process. An important advantage of the concrete vault which is poured at the site, however, is that it readily satisfies banking regulations since the unified structure is considered "burglar-proof", namely, it has no seams or openings which allow a direct path of entry.

SUMMARY OF THE INVENTION

According to the present invention, and forming a primary objective thereof, a prefabricated type bank vault is provided that combines features of being economical to manufacture, sturdy in construction, "burglar-proof" to the extent required by banking regulations, aesthetic in appearance, and furthermore that can be used either as a permanent installation or disassembled in the event that temporary use is desired.

In carrying out the objectives of the invention, prefabricated members comprising a floor, a roof, side walls, and end walls have a jointed overlapping connection with adjacent members. Such adjacent members have joint surfaces offset from each other inwardly of the seams of the joints to provide non-continuous "burglar-proof" seams from the exterior of the vault to the inner protected area. The overlying construction of the jointed connections between the side and end walls with the roof and floor extend fully to the top of the roof and fully to the bottom of the floor to eliminate visible horizontal seams at the sides and ends. Disconnectable securing means are used adjacent the joints for separating the vault members in the event of a temporary installation.

The invention will be better understood and additional objects and advantages will become apparent from the following description taken in connection with the accompanying drawings.

DETAILED DESCRIPTION OF A PREFERRED EMBODIMENT

Figure 1:
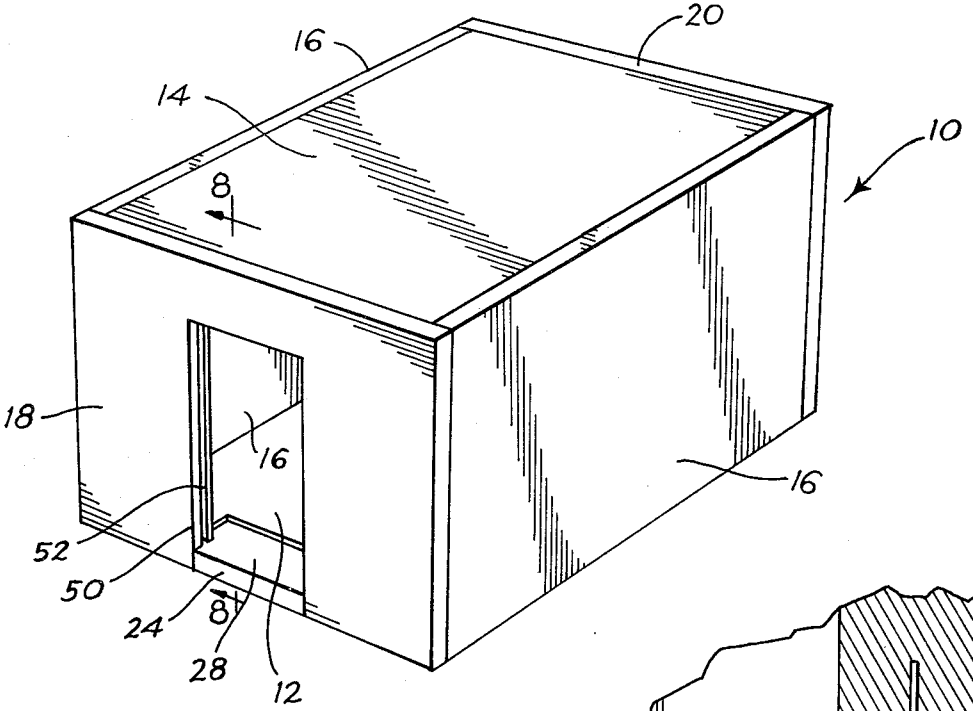
FIG. 1 is a perspective view of a concrete vault construction embodying features of the present invention.
Figure 2:
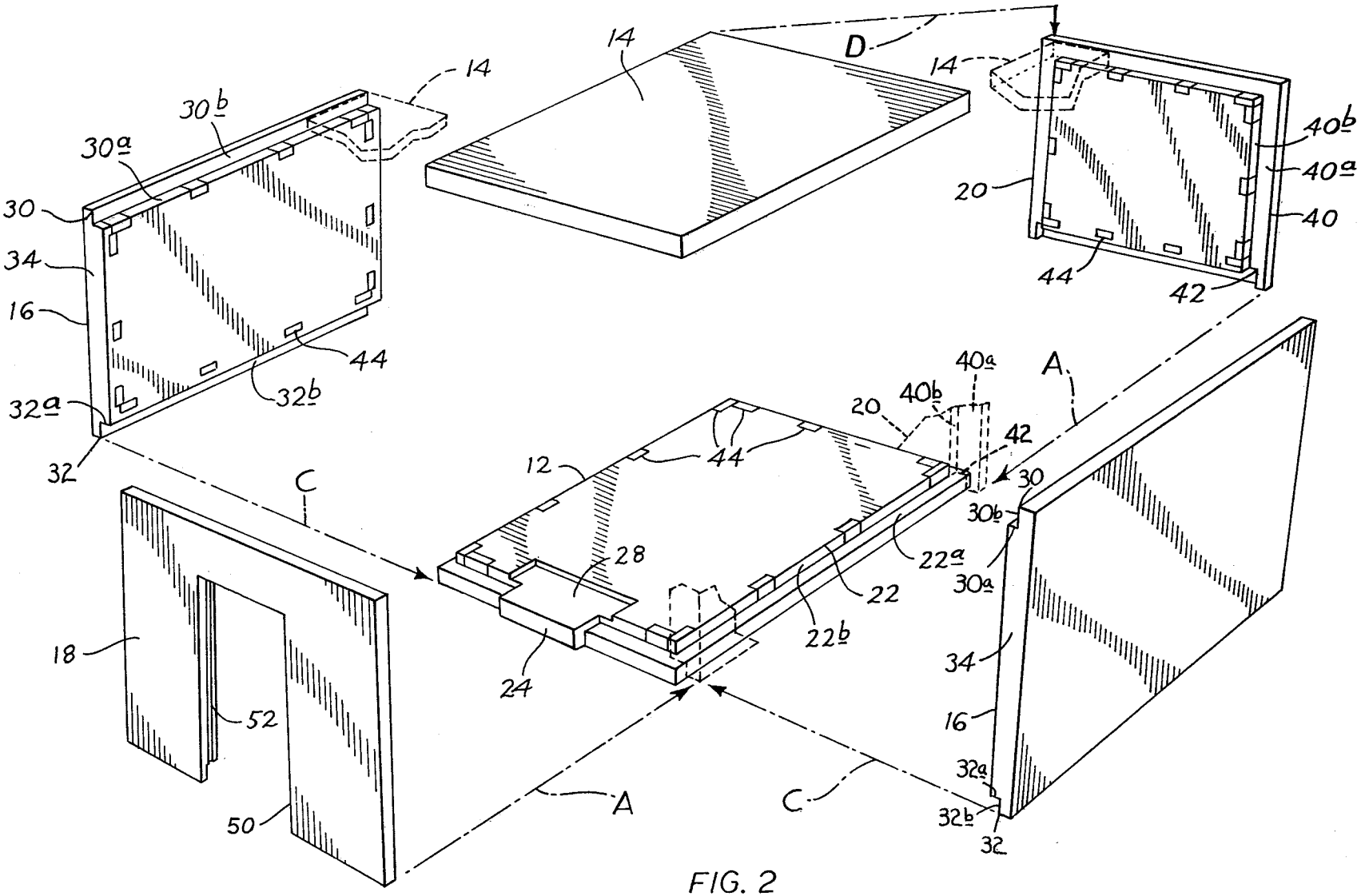
FIG. 2 is an exploded assembly view of prefabricated component parts of the vault, this view including assembly arrows and also including some broken line positions of joint connections.

Referring in particular to the drawings and first to FIGS. 1 and 2, FIG. 1 shows a completely assembled vault 10 except for the door and door hardware and FIG. 2 shows component parts of the vault comprising a floor slab or bottom wall 12, a roof slab or top wall 14, side walls 16 of identical structure, a front end wall 18, and a rear end wall 20. Although the walls 16, 18 and 20 are referred to herein as side walls, a front wall and a rear wall, respectively, it is to be understood that such are not limitations on the structure since any wall arrangement and door opening may be used. According to one feature of the invention, these vault members are prefabricated in a manufacturing plant and transported to the site of the bank being constructed and moved into place by power machinery.

Conventional footings, not shown, are first constructed at the site, and the floor 12 is suitably supported on such footings. This floor has a groove or rabbet 22 around its edge forming a horizontal edge surface **22*a* and a vertical edge surface 22*b*. Edge surfaces 22*a* at the ends of the floor are somewhat elongated relative to the side surfaces 22*b*. Groove 22 is continuous around the floor 12 except for an interruption at a front projection 24 which forms a base for a door as will become more apparent hereinafter. The top surface 28 of projection 24 is recessed below the top surface of the floor 12 and leads rearwardly into a vault area. The purpose of the recessed surface 28** will also become more apparent hereinafter.

Side walls 16 have top and bottom inwardly facing grooves or rabbets 30 and 32, respectively, the grooves 30 forming horizontal edge surfaces **30*a* and vertical edge surfaces 30*b* and the grooves 32 forming horizontal edge surfaces 32*a* and vertical edge surfaces 32*b*. Grooves 30 and 32 extend the full length of the walls 16. The end edges 34 of the walls 16** are flat.

Each of the end walls 18 and 20 has an inwardly facing groove 40 around its edge. This groove forms an edge surface **40*a* facing inwardly of the vault and edge surfaces 40*b* facing the peripheral edges of the walls. Groove 40 is continuous around each of the end walls but has a countersunk or recess portion 42 along the bottom which terminates short of the side edges of the walls but beyond the lateral plane of the vertical edges 40*b***.

Roof 14 comprises a flat slab-like structure.

Figure 8:
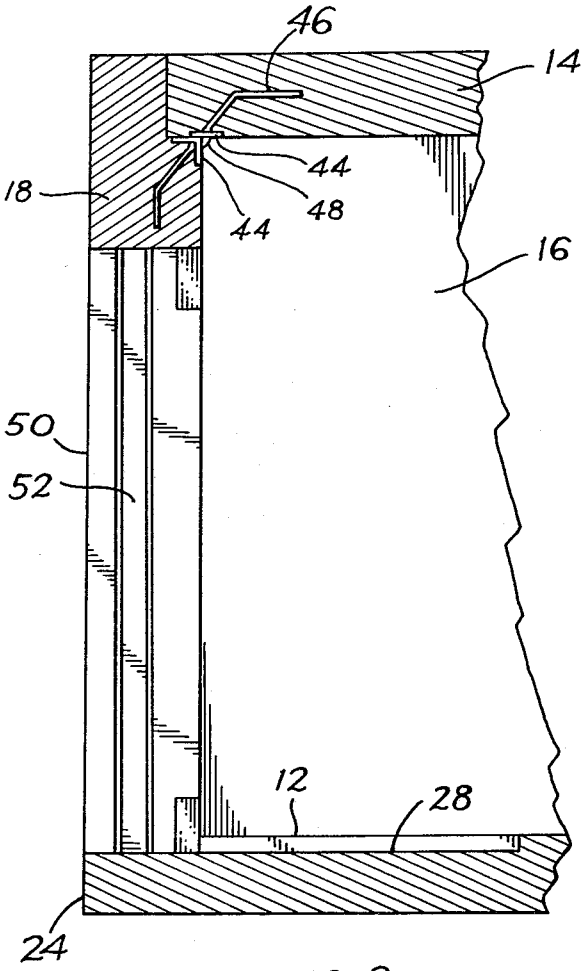
FIG. 8 is an enlarged fragmentary sectional view illustrating a door opening construction, this view being taken on the line 8—8 of FIG. 1.

The component parts are secured together by means which provide a rugged connection but which at the same time can be released if desired. A preferred securing means comprises a plurality of metal plates 44, FIGS. 2, 7 and 8 molded in the parts in flush surface association and anchored in place by anchor studs 46. Plates 44 are selectively located so as to be closely adjacent the joints and associated with matching plates on adjacent walls whereby they can be welded together by suitable weld material 48. The plates 44 where possible are right angle in configuration so as to be embedded in two surfaces to provide a rugged connection. The securing means 44, 48 can be released by burning out the welds 48 in the event the vault is to be moved.

The vault is provided with a suitable door opening 50 which may be in the front wall 18 as illustrated or in any other location. A door frame, not shown, of conventional construction is arranged to be secured in this opening. The sides of the opening are grooved at 52 to provide a grout strip and securement of the frame in place may be by means of metal weld plates 44 as described in connection with the walls. The purpose of recessed area 28 at the projection 24 is to allow installation of a door frame, namely, after the frame has been moved in place by sliding it in the opening and then raising it to a use position, the recess 28 is filled in with concrete.

Although not detailed herein, the wall panels are provided with the necessary steel reinforcement as required by banking regulations.

Figures 3, 4, 5, 6:
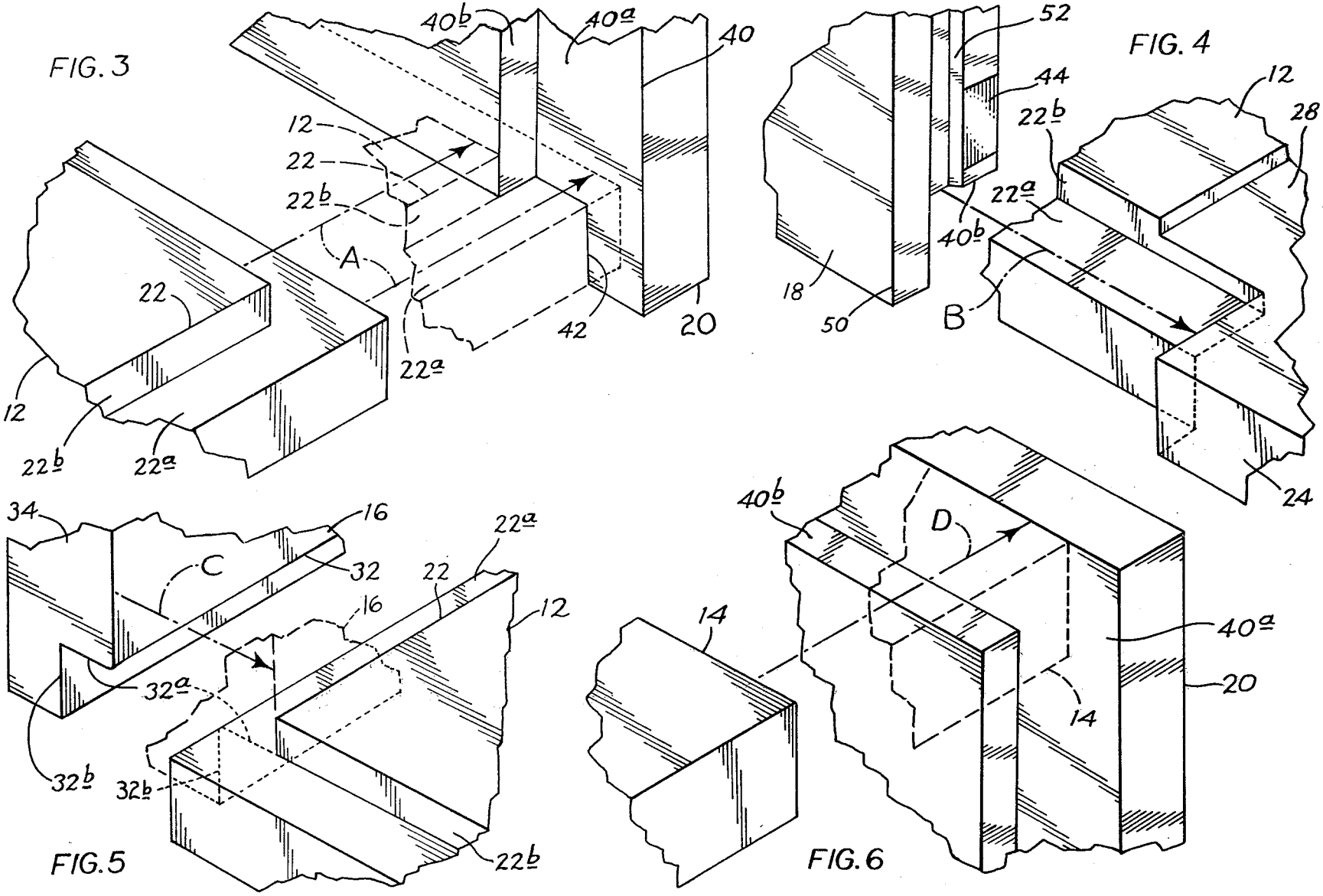
FIG. 3 is an exploded view of a joint connection between a rear end wall of the vault and the floor.
FIG. 4 is an exploded view of a joint connection between a front end wall and the floor, the front wall having a door opening.
FIG. 5 is an exploded view of a joint connection between a side wall and the floor.
FIG. 6 is an exploded view of a joint connection between an end wall and the roof.

In the assembled condition of the vault and with particular reference to FIGS. 2 through 6, the end walls 18 and 20 seat on the edges of the floor 12 with the horizontal bottom edge surfaces 40*b* of grooves 40 seated on the edge surfaces 22*a* of the grooves 22 in an overlapping or rabbet-type joint. This assembly is detailed in FIG. 3. In addition to the overlapping relation as mentioned and also with reference in particular to FIG. 3, elongated edge surfaces 22*a* of the floor 12 project into the countersunk portions 42 of the grooves 40 with the terminal end edges of the floor 12 projecting fully into the countersunk portions 42 and the edge surfaces at 22*b* of the floor abutting against the inner surfaces of the front and rear walls. The terminal side edges of the floor 12 at its ends fit against the defining side edges of countersunk portion 42. Arrows A in FIGS. 2 and 3 show the assembly of the end walls 18 and 20 with the floor 12. FIG. 4 shows a detail assembly view of the front wall 18 and the floor 12 at the door opening 50. The upright defining edges of the door opening abut against the sides of the projection 24 and the end edges 40*b* seat on the end edges 22*a* of the floor. The inner surface of wall 18 at the lower portion thereof abuts against end edge 22*b*. Arrow B in FIG. 4 shows the assembly of the front wall with the floor.

With reference to FIGS. 2 and 5, the side walls 16 seat on the floor 12 with the edge surfaces 32*a* of grooves 32 thereof seating on edge surfaces 22*a* and edge surfaces 32*b* in abutment with the terminal side edges of the floor. The inner facing surfaces of the walls abut against edge surfaces 22*b*. Arrows C in FIGS. 2 and 5 show the assembly of the side walls 16 with the floor 12. An overlapping or rabbet-type fit is provided by the grooves 22 and 32, the jointed association being dimensioned and arranged such that the outer surfaces of the side walls 16 are flush with the side edges of end walls 18 and 20. The flat end edges 34 of the side walls abut against the groove edge surfaces 40*a* in the end walls 18 and 20 and the inner facing surfaces of the side walls abut against edge surfaces 40*b*. In the assembled relation of the walls as described, namely, with the side walls extending the full height of the vault, and with the end walls having central, end-bounded recessed portions 42 (in grooves 40), which portions receive, complementarily, end projections of the floor, the only seams visible are the four which exist between the side and end walls.

The top wall 14 is seated on the edges 30*a* of the side walls and edges 40*b* of the end walls. This assembly is detailed in FIGS. 2 and 6 and shown by arrows D.

Figure 7:
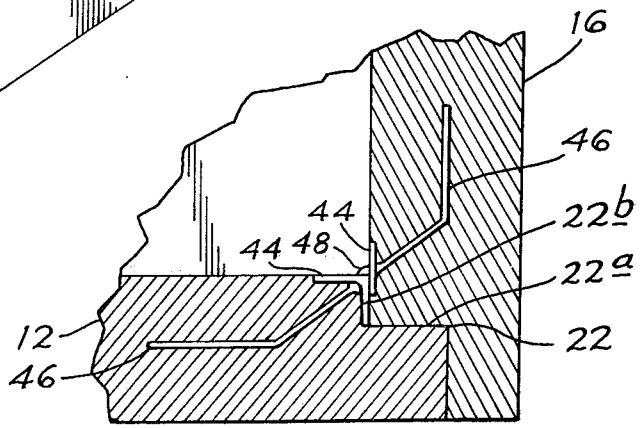
FIG. 7 is an enlarged fragmentary sectional view illustrating securing means for permanently or releasably holding component parts together, this view being taken across a joint connection between a side wall and the floor.

One important feature of the prefabricated vault of the invention is that all of the joint connections of adjacent walls provide a non-continuous "burglar-proof" seam between the exterior of the vault to the protected inner area. That is, in each of such joints, edge surfaces formed by the groove or rabbet-type overlap provide surfaces or edges which are offset from each other so that there is no straight-through seam or direct path of entry. An exemplary joint is shown in FIG. 7 wherein the edge surface 22*a* and the top surface of the bottom wall 12 are offset or interrupted by the edge surface 22*b*. Countersunk areas 42 in the front and rear walls which receive the ends of the floor provide the desired offset seam at the ends of the floor.

Another feature of the present vault is that due to its prefabrication it is economical to construct and also does not materially delay the construction of other portions of the bank.

A further feature of the present vault is that a minimum of exterior seams are visible, thus giving the appearance of a permanent-type installation. In addition, the joint structure and securing means 44 are arranged to provide a permanent installation if in fact the vault is to remain permanently; however, such jointed construction and securing means allows the vault to be used as a temporary installation since the securing means, as hereinbefore stated, can be released from each other merely by burning out the welds 48 and the component parts can be transported away from the site. The present vault may be provided with any suitable roof structure, not shown, in those cases where the installation is exposed to the weather.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A concrete vault construction comprising (a) a wall structure forming an inner protected area, (b) said wall structure comprising roof, floor, side and end wall members having defined peripheral edges, (c) and door means in at least one of said members, (d) said floor, side and end wall members having jointed overlapping connections therebetween, (e) said edges of said members, in said jointed overlapping connections with adjacent members, having joint surfaces offset from each other across the seam of the joint to provide non-continuous burglar-proof seams which lead from the exterior of said vault to the inner protected area, with said connections which exist between said floor and end wall members being defined, in one member associated with the connection, by an end-bounded, elongated recess, and in the other member associated with the connection, by a projection complementarily fitted in said recess.

2. The vault construction of claim 1 wherein the overlapping of said joint connections of said side and end wall members with said roof and floor members extends fully to the top of said roof member and fully to the bottom of said floor member to eliminate a visible horizontal seam at the sides and ends.

3. The vault construction of claim 1 wherein said jointed overlapping connection comprises a peripheral groove in the top surface of said floor member adjacent the defining edge thereof, an inwardly facing groove in said side wall members adjacent the bottom associated with said groove in said floor member to form an overlapping joint at the respective sides of said floor member, an inwardly facing groove in said end wall members adjacent the bottom associated with said groove in said floor member to form an overlapping joint at the respective ends of said floor member, the overlapping of said jointed connections of said side and end wall members with said roof and floor member extending fully to the top of said roof member and fully to the bottom of said floor member to eliminate visible horizontal seams at the sides and ends, said grooves in said end wall members being countersunk to receive an end portion of said floor member and provide a burglar-proof offset across the seam at the ends of said floor member.

4. The vault construction of claim 1 wherein said side and end wall members comprise a prefabricated structure arranged to be jointed with said roof and floor members at the building site in an arrangement providing said burglar-proof seams.

5. The vault construction of claim 1 wherein all of said members comprise a prefabricated structure arranged to be jointed together at the building site in an arrangement providing said burglar-proof seams, and disconnectable securing means adjacent said joints for removably securing said members together.

6. The vault construction of claim 5 wherein said disconnectable securing means comprise metal plates having molded connection in said members adjacent to joint portions thereof and arranged to be welded together to hold said members together and arranged to be separated by burning out the weld when said members are to be removed.

* * * * *